United States Patent [19]

Brownlie et al.

[11] Patent Number: 4,561,693

[45] Date of Patent: Dec. 31, 1985

[54] BACK SUPPORT TILT AND SEAT AND BACK SUPPORT HEIGHT CONTROL MECHANISM FOR A CHAIR OR THE LIKE

[75] Inventors: Alan Brownlie, Skaneateles, N.Y.; Jeffrey D. Crawford, Whitehall; Harold A. Smith, Emmaus, both of Pa.

[73] Assignee: Knoll International, Inc., New York, N.Y.

[21] Appl. No.: 503,227

[22] Filed: Jun. 10, 1983

[51] Int. Cl.[4] ..... A47C 3/30

[52] U.S. Cl. ..... 297/306; 297/305; 297/345; 297/355

[58] Field of Search ..... 297/355, 354, 300, 306, 297/305, 304, 345

[56] References Cited

U.S. PATENT DOCUMENTS

| | | | |
|---|---|---|---|
| 2,015,138 | 9/1935 | Drake | 297/303 X |
| 2,153,327 | 4/1939 | Herold | 297/304 |
| 2,208,561 | 7/1940 | Jungbauer | 297/305 |
| 2,420,745 | 5/1947 | Harman | 297/301 |
| 2,424,753 | 7/1947 | Herold | 297/303 |
| 2,447,601 | 8/1948 | Sengpiel | 297/301 |
| 3,042,448 | 7/1962 | Hamilton | 297/301 |
| 3,434,756 | 3/1969 | Walkinshaw | 297/300 |
| 3,756,654 | 9/1973 | Bauer | 297/345 |
| 3,880,465 | 4/1975 | Scheben | 297/355 X |
| 4,013,257 | 3/1977 | Paquette | 297/304 |
| 4,018,415 | 4/1977 | Wolters | 297/304 X |
| 4,099,775 | 7/1978 | Mizelle | 297/303 |
| 4,328,943 | 5/1982 | Eldon, III | 297/304 X |

*Primary Examiner*—Philip C. Kannan
*Attorney, Agent, or Firm*—Robert Scobey

[57] ABSTRACT

Tilt control for a back support and height control for the back support and a seat for a chair or the like are provided by a gas cylinder actuator having a cam surface and pivotally mounted so that the cam surface activates the gas cylinder. A blocker plate is pivotally mounted for movement between one position in which it prevents tilting of the back support and another position in which tilting is permitted. The actuator and blocker plate are coupled together so that pivotal movement of one is accompanied by pivotal movement of the other.

7 Claims, 5 Drawing Figures

BACK SUPPORT TILT AND SEAT AND BACK SUPPORT HEIGHT CONTROL MECHANISM FOR A CHAIR OR THE LIKE

BACKGROUND AND BRIEF DESCRIPTION OF THE INVENTION

This invention relates to tilt and height control for chairs or the like, and is particularly directed to providing an adjustment mechanism for varying the tilt of a back support and the height of the back support and a seat in a chair.

U.S. Pat. No. 4,328,943 issued on May 11, 1982, directed to a tilt control mechanism for a chair achieving height variation by suitable activation of a gas cylinder mechanism. The control assembly disclosed in that patent is particularly suited for tilt control in a chair in which the seat and back support together tilt as a unit. The present invention, on the other hand, is directed to tilt and height adjustment in a chair in which only the back support tilts.

The present invention provides such control in a compact mechanism utilizing a gas cylinder actuator having a cam surface thereon and which is pivotally mounted so that the cam surface activates the gas cylinder upon appropriate pivotal movement of the actuator. A blocker plate is also utilized which pivotally moves between one position in which tilting of the back support is prevented and another position in which tilting is permitted. The actuator and blocker plate are coupled together so that pivotal movement of one is accompanied by pivotal movement of the other. This is preferably achieved by use of an activating lever having two terminal portions, one of which is responsible for the pivoting of the gas cylinder actuator and the other of which causes pivoting of the blocker plate.

The compactness of the overall assembly of the present invention is achieved in large part by closely mounting with respect to each other the gas cylinder actuator and the blocker plate, both of which are mounted for pivotal movement about axes substantially perpendicular to each other. Additionally, the prevention of tilting in the chair is achieved by the blocking of a pin carried by the moving tilt mechanism, in this case the pin preferably extending through the spring that biases the back support of the chair in an upright position.

The invention will be more completely understood by reference to the following detailed description of a presently preferred embodiment thereof.

DETAILED DESCRIPTION

Figure 1:
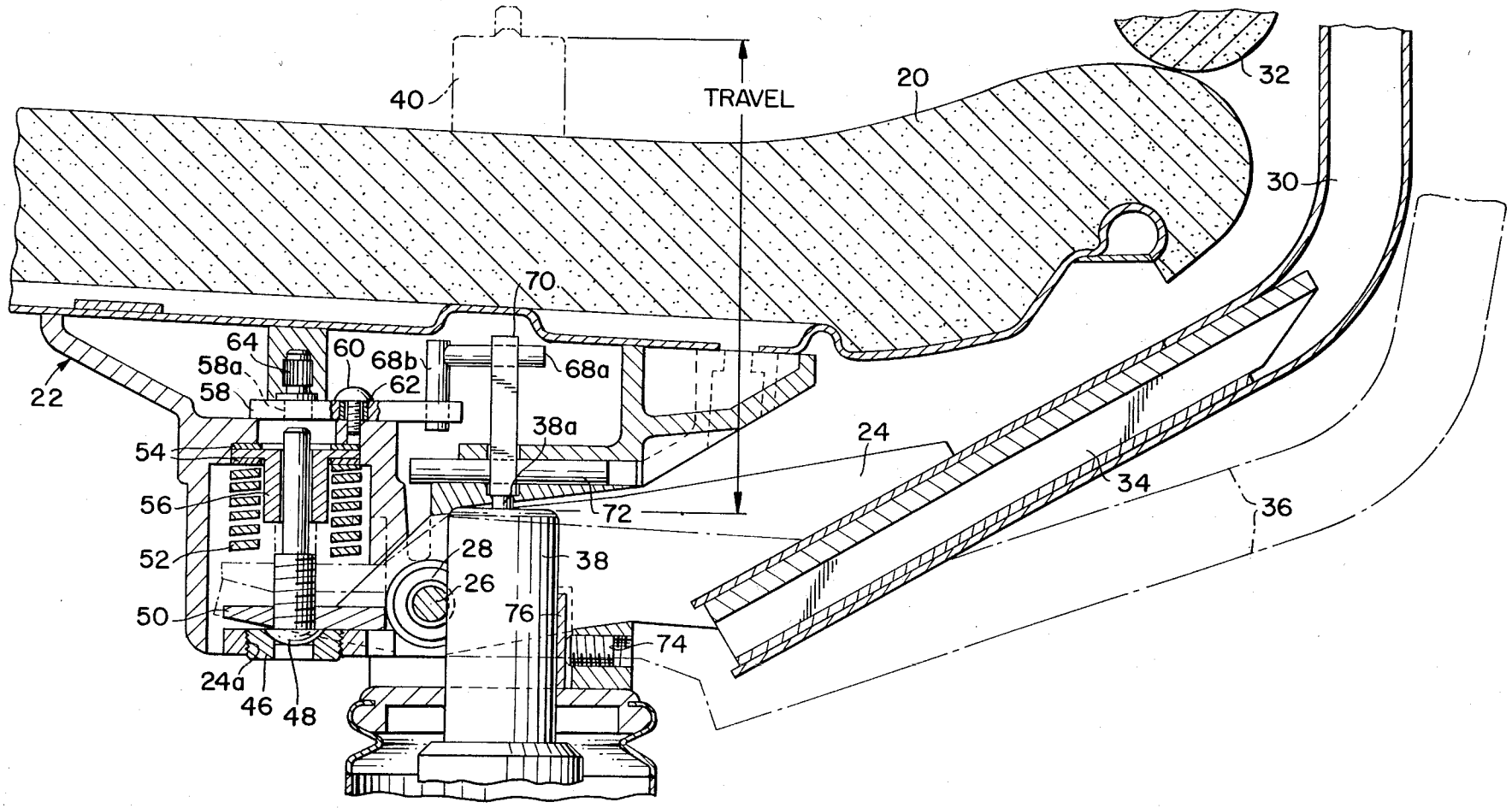
FIG. 1 is a side view, in section, of a tilt and height control mechanism embodying the present invention.

Referring to FIG. 1, a presently preferred embodiment of the invention is shown in the environment of a chair which includes a seat 20 that is supported by a seat support 22. A back support pivot plate 24 is mounted for pivotal movement with respect to the seat support

22 by a pivot pin 26 mounted in bushing 28. A tubular back support 30 is included that carries a back support cushion 32. The back support 30 is mounted to the pivot plate 24 via channel member 34 which is a part of the pivot plate 24. The tubular back support 30 pivots through a limited angular range, as will be explained in more detail below. The limits of the angular movement are shown in FIG. 1 by the full line representation (back cushion 32 in "upright" position) and by dashed lines 36 (representing full "tilting").

A conventional gas cylinder mechanism 38 is included, having an actuator control "button" 38*a*, for seat height adjustment (and also height adjustment of the back support cushion). The lowermost position of the gas cylinder is shown in full lines in FIG. 1; dashed lines 40 represent the highest raised position of the gas cylinder mechanism, the extent of gas cylinder movement is indicated by the notation "travel" in FIG. 1.

Figure 3:
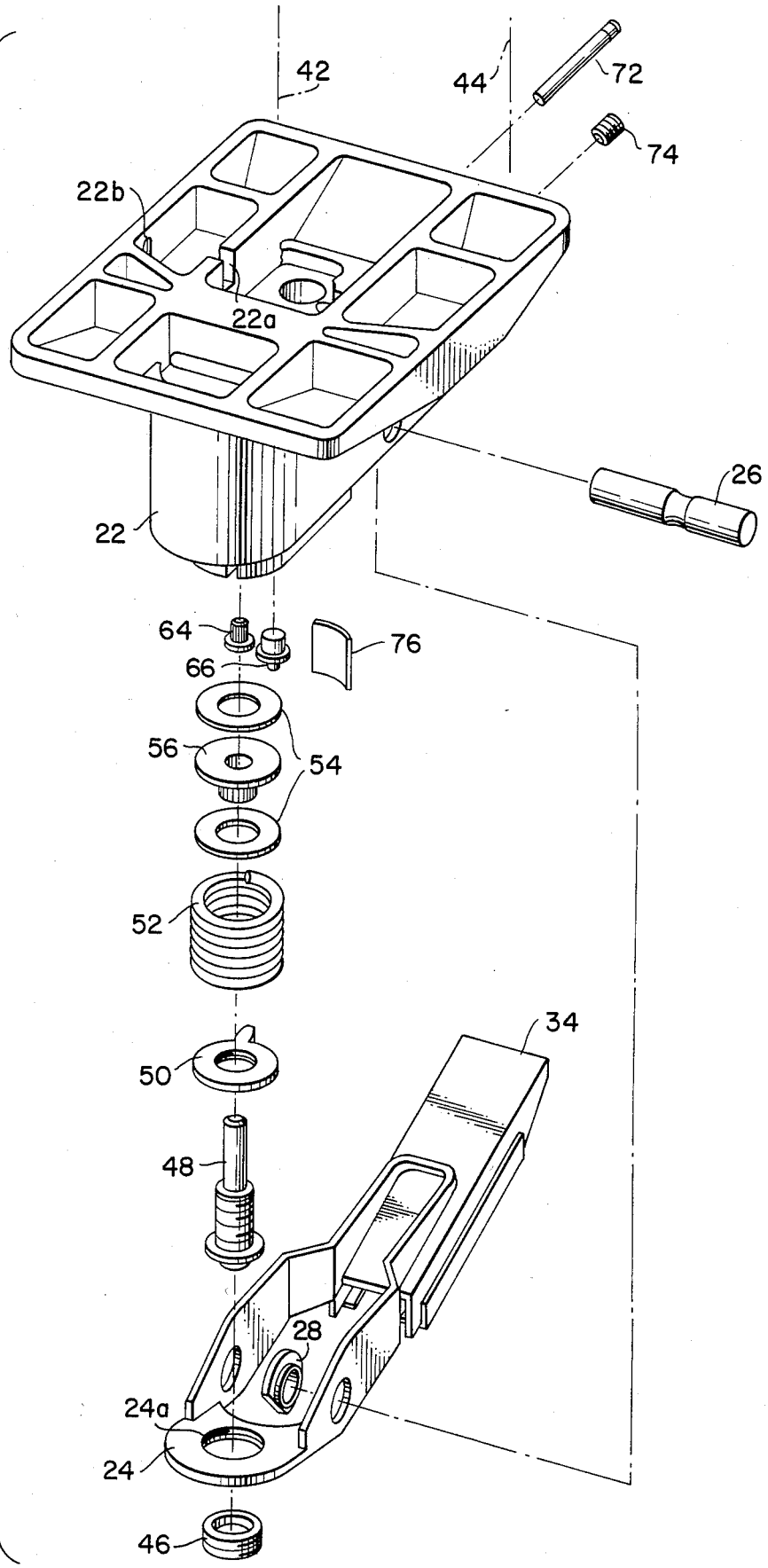
FIGS. 3 and 4 are exploded perspective views which, when taken together, show the parts of the control mechanism of FIG. 1.
Figure 4:
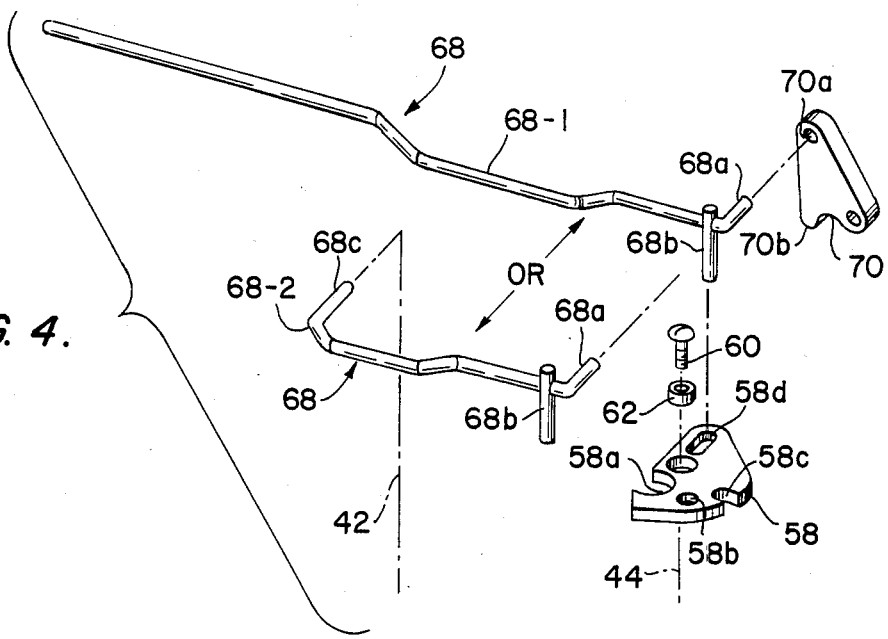

Refer to FIGS. 1, 3 and 4. FIGS. 3 and 4 are to be viewed together, with FIG. 4 above FIG. 3, by aligning the dashed lines 42 and 44 in the two figures. The back support pivot plate 24 includes a threaded opening 24*a* in a forward portion thereof into which a lockout button 46 is threaded. The lockout button supports a tension adjuster bolt 48 onto which a tension adjuster nut 50 is threaded. The tension adjuster nut bears against compression spring 52. The position of the adjuster nut 50 on the threaded bolt 48 determines the tension in the spring 52 and the force required for tilting of the back support cushion 32.

The upper end of the tension adjuster spring 52 bears against the lowermost one of two thrust washers 54. A bushing 56 is included for guiding the upper, unthreaded end of tension adjuster bolt 48.

The tension adjuster bolt 48 serves a dual purpose. Not only is it responsible for adjustment of the tension of the compression spring 52, but it also participates in the lockout of the tilting action of the back support, as will now be described. In particular, the upper end of the bolt 48, in the position shown in FIG. 1, is immediately below a blocker plate 58. The blocker plate is mounted for pivotal movement within the housing 22 by a screw 60 that passes through sleeve 62. The blocker plate 58 includes an opening 58*a* through which the upper end of the tension adjuster bolt 48 may extend when the bolt and opening are aligned. An impact button 64 is included in the housing 22 to bear the brunt of the striking force of the upper end of the tension adjuster bolt 48. When the opening 58*a* in the blocker plate 58 is aligned with the tension adjuster bolt 48, permitting the upper end of the bolt to pass through the blocker plate, tilting of the back support mechanism 30 is possible. When the blocker plate is pivoted so that the opening 58*a* and bolt 48 are no longer in alignment, the solid blocker plate 58 prevents upward movement of the tension adjuster bolt 48 and thereby prevents any tilting action to take place. The pivoting of the blocker plate 58 will be described in more detail below.

The blocker plate 58 includes openings 58*b* and 58*c* therein. These openings coact with a detent assembly 66, to retain the blocker plate in predetermined angular positions. Pivoting of the blocker plate 58 is controlled by an activating lever 68. There are two different levers shown in FIG. 4 (levers 68-1 and 68-2). The lever 68-1 is intended for use in an armless chair; the lever 68-2 is intended for use in an arm chair. Each of the levers 68 includes terminal portions 68*a* and 68*b*, which constitute rod ends that are substantially perpendicular to each other. The terminal portion 68*b* extends through a slotted opening 58*d* in the blocker plate 58. Movement of the activating lever 68 causes appropriate pivoting of the blocker plate 58.

The other terminal portion 68*a* of the activating rod 68 extends through an opening 70*a* in a gas cylinder actuator 70. The actuator 70 is mounted for pivotal movement in the housing 22 by pivot pin 72. The actuator 70 includes a camming surface 70*b* which actuates the gas cylinder control button 38*a* upon suitable pivoting of the actuator 70 by movement of the activating lever 68. That activating lever is guided through slots 22*a* and 22*b* in the housing 22. The housing is mounted to the gas cylinder 38 by means of set screw 74 which bears against cylinder segment 76.

Figure 2:
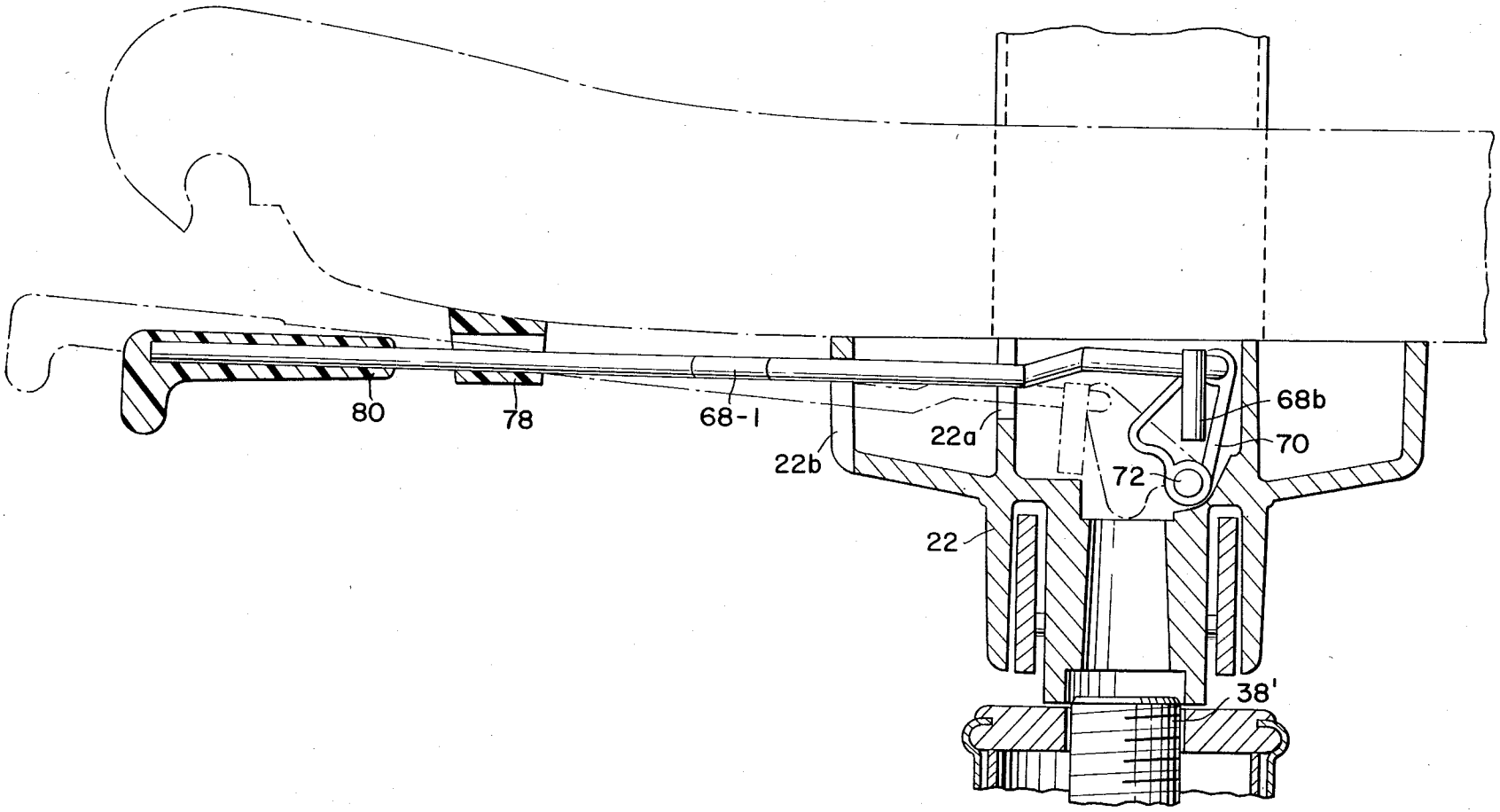
FIG. 2 is a front view, in section, of the mechanism of FIG. 1, with some parts changed and others omitted for clarity.

Referring to FIG. 2, which is a front view of the assembly, the control in an armless chair is illustrated. Thus the activating rod 68-1 is shown, supported by a support block 78 and terminating in a handle 80. In this figure, a gas cylinder mechanism is not shown, and the assembly instead is shown with a conventional threaded height adjustment mechanism 38'. Obviously, there is no gas cylinder actuation, and the gas cylinder actuator 70 is superfluous, except for supporting and guiding the end rod 68-1. However, FIG. 2 is included to show that the overall mechanism may be utilized in such a chair assembly. Also, FIG. 2 does show the pivoting action of the gas cylinder actuator 70 from the full line position in the figure to the dashed line position corresponding to gas cylinder actuation. It should also be noted with respect to FIG. 2 that the blocker plate 58 is not shown for the purpose of better illustration of the pivoting action of the gas cylinder actuator 70.

Figure 5:
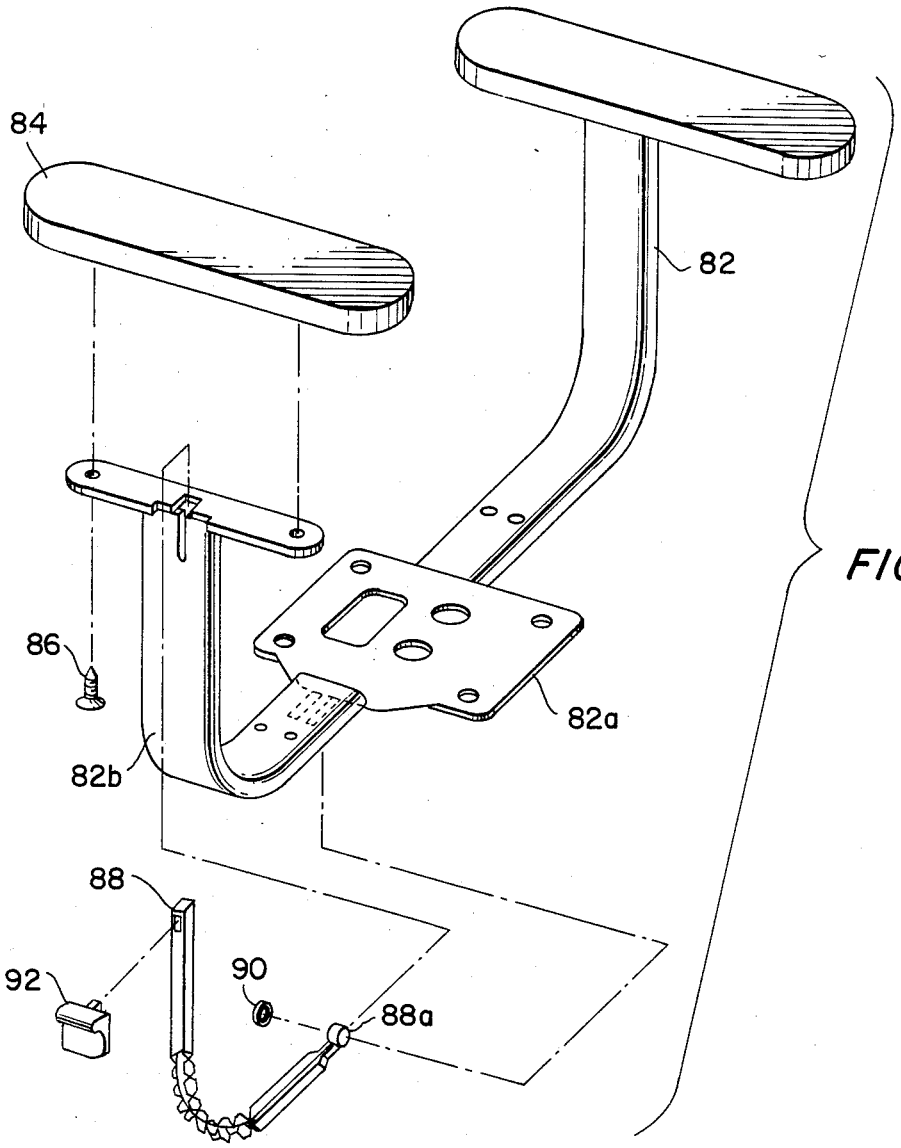
FIG. 5 is an exploded perspective view of a mechanism employed in an arm type chair.

Referring to FIG. 5, an arm assembly 82 is shown having a mounting portion 82*a* adapted to be positioned on top of the housing 22 to complete a chair with arms. Arm rests 84 may be included, held in place by bolts 86. One of the arms (82*b*) is adapted to contain a flexible link 88, the lower end 88*a* of which is adapted to be secured to end 68*c* of the activating lever 68-2 by means of a spring grip fastener 90. The flexible link 88 may terminate in an actuating handle or button 92 which is actuated to move the activating lever 68-2.

In summary, the blocker plate 58 and the actuator 70 are mounted adjacent to each other for pivotal movement about axes perpendicular to each other. The terminal portions 68*a* and 68*b* of the activating lever 68 cause the pivoting of the gas cylinder actuator 70 and the blocker plate 58, respectively. It should be noted that the opening 58*d* in the blocker plate 58 is slotted to permit planar movement of the terminal portion 68*b* of the activating lever 68 while concurrently permitting pivotal movement of the blocker plate in a perpendicular plane.

In use, the blocker plate 58 is normally detented to a position in which the solid part of the plate engages the upper end of the tension adjuster bolt 48, preventing any tilting of the back support assembly 30. Upon initial movement of the activating lever 68 to the next detent position of the blocker plate, the opening 58*a* in that blocker plate is aligned with the bolt 48, permitting full tilting action to take place. During this initial movement of the activating lever from one detent position to the other, the actuator 70 pivots, but not sufficiently to actuate the gas cylinder actuating button 38*a*. Further movement of the activating lever 68 causes complete pivoting of the actuator 70 and actuation of the button 38*a*, thereby permitting a raising or lowering of the chair seat and back as a unit.

It will be appreciated that modifications of the presently preferred embodiment described above are capable of being made by those skilled in the art. Such modifications should be held to be within the scope of the patent, which is to be determined by the following claims.

What is claimed is:

1. A tilt and height control mechanism for a chair or the like in which height adjustment is achieved by a gas cylinder and in which a back support tilts with respect to a seat support, said control mechanism comprising a gas cylinder actuator having a cam surface thereon and pivotally mounted so that said cam surface activates said gas cylinder upon pivotal movement of said actuator, and a blocker plate pivotally mounted for movement between one position in which it prevents tilting of said back support and another position in which said tilting of said back support is permitted, said actuator and blocker plate being coupled together so that pivotal movement of one is accompanied by pivotal movement of the other.

2. A tilt and height control mechanism according to claim 1, including an activating lever coupled to said actuator and blocker plate to cause the pivotal movmement thereof.

3. A tilt and height control mechanism according to claim 2, in which said activating lever comprises a rod having a first terminal portion riding in an opening of said gas cylinder actuator to cause pivotal movement of said actuator upon movement of said rod, said rod having a second terminal portion riding in an opening of said blocker plate to cause pivotal movement of said blocker plate upon movement of said rod.

4. A tilt and height control mechanism according to claim 3, in which said terminal portions of said rod are substantially perpendicular to each other, and said actuator and blocker plate are pivotable about axes substantially perpendicular to each other.

5. A tilt and height control mechanism according to claim 4, in which at least one of said openings in said actuator and blocker plate is slotted to permit linear movement of the associated terminal portion of said rod therein while concurrently causing pivotal movement of the associated one of said actuator and blocker plate.

6. A tilt and height control mechanism according to claim 1, in which said back support is biased to an upright position by a spring, and including a pin connected to said back support and passing through said spring and bearing against said blocker plate in said one position in which tilting of said back support is prevented, said blocker plate containing an opening therein which is in registry with said pin in said another position of said blocker plate to permit movement of said pin and concomitant tilting of said back support.

7. A compact tilt control mechanism for a chair or the like in which a back support is biased to an upright position by a spring, said mechanism comprising a pin connected at a first end thereof to said back support and passing through said spring, said pin terminating in a terminal end surface at a second end thereof, and a movable blocker plate positioned adjacent said second end of said pin, said blocker plate having a solid portion that, in one position of said blocker plate, bears against said pin terminal end surface and blocks movement of said pin and prevents tilting of said back support, said blocker plate having an opening therein that, in another position of said blocker plate, is in registry with said second pin end to permit movement of said pin and permits tilting of said back support.

* * * * *